United States Patent [19]

Fort

[11] Patent Number: 4,526,363

[45] Date of Patent: Jul. 2, 1985

[54] GRIPPER FOR TEXTILE CLOTH OR THE LIKE

[75] Inventor: Jacques Fort, Darnieulles, France

[73] Assignee: Sapivog, Darnieulles, France

[21] Appl. No.: 471,496

[22] Filed: Mar. 2, 1983

[30] Foreign Application Priority Data

Mar. 19, 1982 [FR] France ..... 82 04706

[51] Int. Cl.[3] ..... B65H 3/22; B65H 5/14

[52] U.S. Cl. ..... 271/268; 271/10; 271/18.3; 271/24; 901/39; 901/37; 294/99.1; 414/120

[58] Field of Search ..... 271/10, 16, 17, 18.3, 271/19, 21, 22, 24, 25, 268; 414/751, 71, 120; 901/30, 31, 39, 37, 50; 294/99 R, 115

[56] References Cited

U.S. PATENT DOCUMENTS

| | | | |
|---|---|---|---|
| 1,634,856 | 7/1927 | Skroch | 294/99 R |
| 3,813,094 | 5/1974 | Walton et al. | 271/18.3 |
| 4,082,260 | 4/1978 | Nilsson et al. | 271/24 |
| 4,386,770 | 6/1983 | Hellin | 271/18.3 |

FOREIGN PATENT DOCUMENTS

| | | | |
|---|---|---|---|
| 602542 | 6/1980 | Japan | 271/18.3 |

OTHER PUBLICATIONS

"Gripper Mechanism", IBM Technical Disclosure Bulletin, vol. 17, No. 8, Jan. 1975.

*Primary Examiner*—Bruce H. Stoner, Jr.
*Assistant Examiner*—Alvin Oberley
*Attorney, Agent, or Firm*—Fisher, Christen & Sabol

[57] ABSTRACT

This gripper is applicable more particularly to textile machines and includes a gripping clamp and an apparatus for opening and closing the clamp. The clamp proper includes a fixed central member provided laterally and on either side with a resilient portion, two arms crossing each other for constituting a pair of gripping jaws, each arm being provided with a key preferably in the outer extension of the resilient portion. The opening and closing apparatus includes a pair of vertically movable fingers, by reason of one per arm, which are adapted in their lower position to depress the keys in order to cause the distortion of the resilient portions and thus modify the degree of crossing of the jaw forming portions.

8 Claims, 5 Drawing Figures

GRIPPER FOR TEXTILE CLOTH OR THE LIKE

BACKGROUND OF THE INVENTION

This invention relates to a gripper applicable more particularly to a device adapted to pick up sheets one by one from a texile wad or pile obtained for example by saw-cutting.

THE PRIOR ART

For the same purpose, various solutions have already been proposed, such as mechanical means as in the GB Pat. No. A-1,414,899, electrical means as in the B.E. Pat. No. A-672,325, pneumatical means as in the U.S. Pat. No. A-3,588,091, or in a modified embodiment described in the above-mentioned GB Patent.

This GB Patent discloses notably a device based on the well-known principle of gripping paper sheets one by one from a ream by means of rollers in a duplicator.

Now whereas with paper sheets, a material having a certain firmness in the plane of the sheet, a defective operation is only accidental, this does not apply when the same system is utilized for transferring a soft material like cloth.

The above-mentioned Belgian Patent describes a twin-jaw gripper, in which one jaw moves parallel to the other under the control of an electromagnet.

Now this particular device does not warrant a perfect sheet-by-sheet grip since each time the jaws approach each other the movable jaw and the presser member rigid therewith shift not only the sheet to be picked up but also the next sheets underneath.

SUMMARY OF THE INVENTION

The present invention relates to a clamp-type textile-sheet gripping device which is free of the inconveniences of the prior art devices mentioned hereinabove, and yet simple and economical to manufacture.

The gripper according to the instant invention comprises a clamp and means for opening and closing this clamp. The clamp proper comprises a fixed central member provided laterally, on either side of a resilient portion, with two arms crossing each other to constitute the gripping jaws, each arm being further provided, preferably as the extension of the resilient portion, with a key.

The opening and closing means comprise a pair of vertically movable fingers (one per arm) adapted, in their lower position, to exert a pressure on the corresponding keys in order to cause a certain distortion of the resilient portions and thus modify the crossing of the jaw forming portions.

Other features and advantages of the invention will appear as the following description proceeds with reference to the accompanying drawings.

THE DRAWINGS

DESCRIPTION OF THE PREFERRED EMBODIMENT

Figure 2:
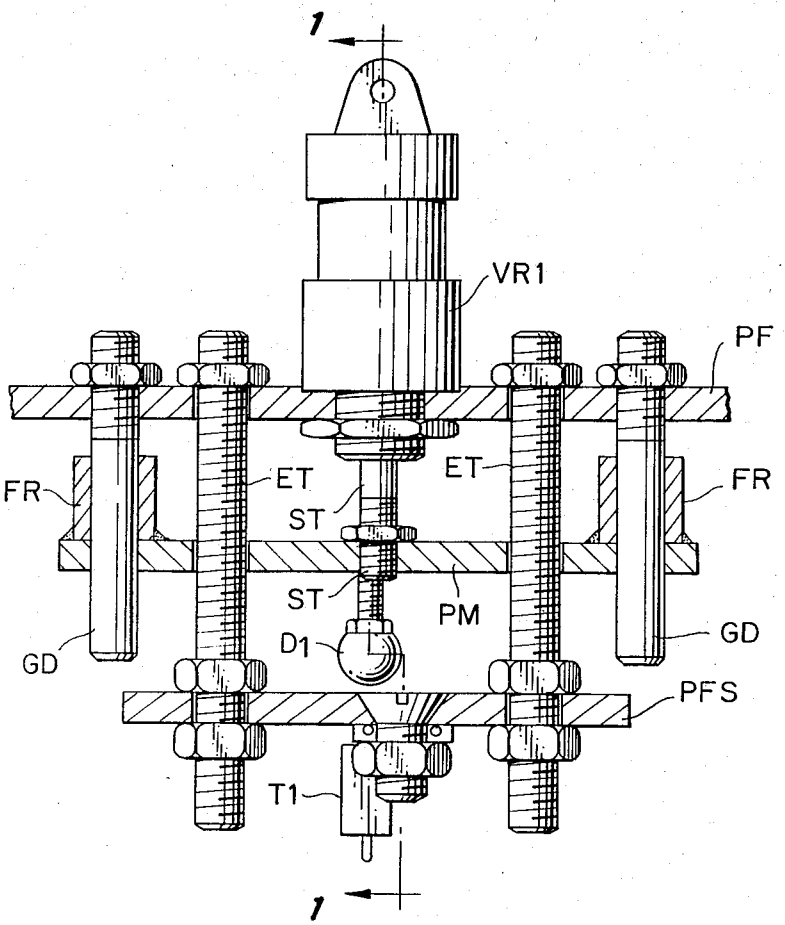
FIG. 2 is an elevational and sectional view corresponding to FIG. 1 but taken from one side thereof.

Referring to the drawings, the gripper PH comprises a vertically fixed portion consisting of a fixed plate PF to which are secured on the one hand a fluid-operated cylinder VR1 and on the other hand, through distance-pieces such as ET, a second fixed plate PFS. The cylinder VR1 actuates a piston rod ST.

Secured to this second fixed plate PFS is the central portion PC of a clamp P.

On either side, this central portion PC has a resilient extension PE of one of the arms B1 (or B2) crossing each other to constitute the gripping jaws BC.

Each arm is provided with a key T1 (or T2) for a purpose to be explained presently.

The clamp advantageously consist of five component elements: a hardened steel wire constituting said portions PC and PE, a second steel wire bent to a forked configuration with bent end portions (B1) and BC, respectively, a third steel wire terminating with a hook and two splitters assembling between them, by pairs, the aforesaid wires; these splitters advantageously constitute the keys T1 and T2.

Figure 3:
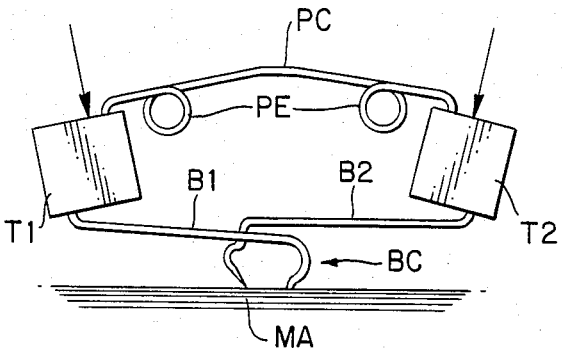
FIGS. 3 and 4 are diagrammatic fragmentary views showing the other two positions of the arms constituting the gripping jaws.
Figure 4:
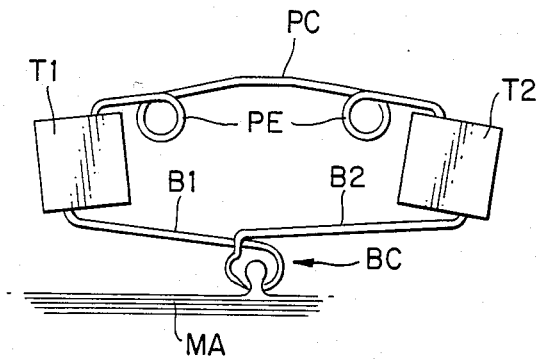

It will be easily understood that when the central portion PC is held against vertical movement and a downward thrust is exerted on keys T1 and T2, the arms B1 and B2 will cross each other differently, so that the jaws BC will open (FIG. 3) and then reclose when the pressure is relieved (FIG. 4).

Therefore, to open and close the jaws, two fingers (D1, D2) are used; these fingers D1, D2 overlie the keys T1, T2 and are carried by a movable plate PM rigidly fastened to the piston rod ST of the fluid-actuated cylinder VR1. In order to guide the fingers towards the underlying keys T1 and T2, the movable plate PM is guided by fixed rods GD slidably engaging corresponding vertical bores formed through sockets FR welded or otherwise secured to this plate (FIG. 2). The piston rod ST is threadedly engaged in the plate PM as shown in FIGS. 1 and 2, the piston rod ST having an end terminating (as shown) just below the bottom surface of the plate PM.

Figure 1:
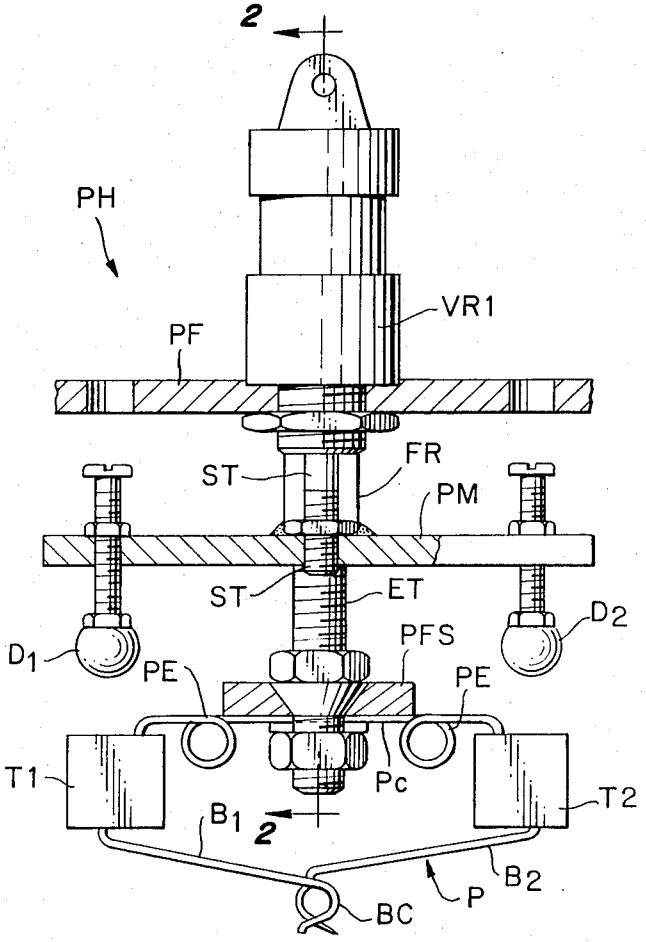
FIG. 1 is an elevational and part-sectional view showing the gripper of the present invention in its closed position.

The fingers D1 and D2 are vertically adjustable by engaging with their threaded shank corresponding threaded holes formed through plate PM (FIG. 1).

Stress may be laid on the fact that this vertical adjustment is particularly important for its permits of adjusting very accurately the action exerted by fingers D1, D2 on keys T1, T2 and, consequently, the degree of opening of the jaws, this degree being necessarily adapted to the particular nature of the textile sheet to be picked up.

The above-described gripper should advantageously be incorporated in an sheet pick-up device incorporated in turn in an arrangement for feeding a textile machine, for example a sewing machine.

Figure 5:
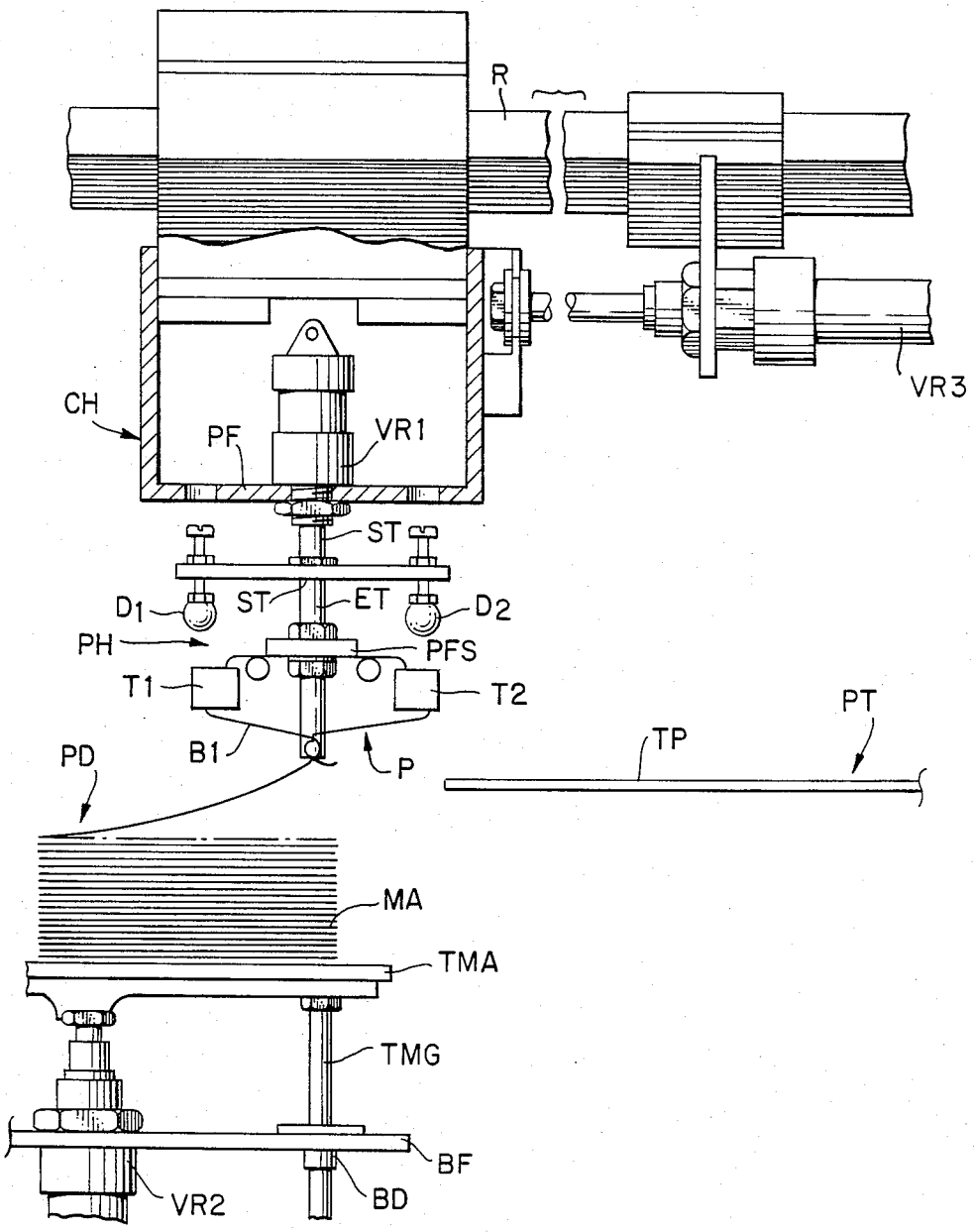
FIG. 5 is a comprehensive view of a working arrangement comprising a sheet pick-up device incorporating the gripper visible in the preceding Figures.

For this purpose, the fixed plate FP (FIG. 5) is an integral part of a carriage CH adapted to travel on a rail R from a sheet pick-up station PD to a treatment station PT under the control of a fluid-operated cylinder VR3 having its piston rod connected to said carriage CH.

The sheet pick-up station is completed by a movable table TMA supporting the pile of sheets MA comprising a great number of textile sheets cut for example simultaneously, for example by sawing.

This table TMA is rigid with the end of the piston rod of another fluid-operated cylinder VR2 secured to the frame structure BF.

Furthermore, the table TMA is rigid with guide rods TMG slidably engaging sockets BD secured to the frame structure BF. During each operation this cylinder VR2 brings the topmost sheet of pile MA beneath the jaws BC of the clamp so that the sheet can be picked up as explained hereinabove.

When the topmost sheet has thus been gripped by the jaws BC, the cylinder VR2 may be vented to permit the downward movement of table TMA while the carriage CH actuated by cylinder VR3 transfers the gripped sheet from the pick-up station PD to the treatment station PT shown in diagrammatic form as comprising essentially a table TP.

The jaws BC then open and release the previously gripped sheet, whereafter the carriage can return to its initial position.

It should be noted that the gripper described hereinabove and illustrated in the attached drawings is particularly reliable due to the adjustment means contemplated which permit, inter alia, of bringing the open jaws BC (FIG. 3) flush to the topmost sheet of the pile without exerting any appreciable pressure against this sheet. The gripping action results from the slight pressure produced by the resilient arms B1 and B2 of which the orientation changes when T1 and T2 rise.

Though a single form of embodiment of the invention has been described and illustrated herein, it will readily occur to those conversant with the art that various modifications and changes may be brought thereto without departing from the basic principles of the invention.

What is claimed as new is:

1. A gripping apparatus for gripping individual sheets of flaccid material, comprising:

a pair of gripping jaws which are normally in a closed position, adapted in said closed position for gripping a sheet of flaccid material;

said pair of gripping jaws being resiliently supported by respective first arms; each said first arm being fixedly connected to a key member;

each said key member having a contact surface thereon adapted to be engaged by a finger member;

each said key member being fixedly connected to a first portion of a resiliently deformable member;

each said resiliently deformable member having a second portion which is fixedly connected to a support member;

a pair of finger members, each respective one of said finger members being selectively movable toward said contact surface of a respective said key member;

means for moving said pair of finger members toward said contact surfaces of said key members to move said key members and to thereby cause deformation of said resiliently deformable members;

whereby said pair of gripping jaws are normally in a closed position, said pair of gripping jaws being selectively operable by movement of said key members which is caused by selective movement of said finger members toward said keys by said means for moving said finger members, in turn causing said first arms to move relative to one another to cause said pair of gripping jaws to move to an open position.

2. A gripping apparatus as claimed in claim 1, wherein said support member, supporting said second portion of each said resiliently deformable member, is a single body supported by a main support member;

said main support member supporting said means for moving said finger members.

3. A gripping apparatus as claimed in claim 2, wherein said fingers are supported by a finger support member;

said finger support member being contrained by at least one guide member, which guide member is fixedly connected to said main support member.

4. A gripping apparatus as claimed in claim 3, wherein said means for moving moves said finger support member selectively toward or away from said single body;

whereby said finger members may be selectively moved into, or out of, engagement with said key members.

5. A gripping apparatus as claimed in claim 4, further comprising a means for adjusting the length of each of said finger members relative to said finger support member.

6. A gripping apparatus as claimed in claim 1, wherein each said resiliently deformable member is a wire member bent so as to have a loop shape therein to permit greater angular deformation about said loop between said first portion and said second portion of said resiliently deformable member.

7. A gripping apparatus as claimed in claim 6, wherein said pair of gripping jaws comprises a hook-shaped member fixed at an extremity of each of said first arms opposite the location of the respective key member connected to the respective first arm;

each hook-shaped member having a tip;

whereby downward deflection of said key members causes movement of each hook-shaped member to an open position wherein said hook-shaped members overlap to form an open space between said tips; and whereby return of said key members to their undeflected positions causes said tips to overlap, thereby gripping a sheet of flaccid material therebetween.

8. An apparatus for gripping sheets and moving them to another location, comprising:

a main support plate;

a means for moving said main support plate;

a finger support member movably connected to said main support plate by a means for moving said finger support member;

a pair of fingers connected to said finger support member, each of said fingers being adapted to deflect a key member;

two key members, each respectively mounted by a resiliently deformable member to a key support member;

said key support member being fixedly connected to said main support member and spaced a predetermined distance therefrom;

a pair of gripping members, each respectively connected to a key member;

whereby deflection of said key member by said finger members causes opening of said gripping members; and whereby return of said key members to an undeflected position causes closing of said gripping members to grip a sheet; and whereby said means for moving said main support plate moves the gripped sheet from its original location to another location.

* * * * *